US006573833B1

(12) United States Patent
Rosenthal

(10) Patent No.: US 6,573,833 B1
(45) **Date of Patent: *Jun. 3, 2003**

(54) ACOUSTIC FINDING SYSTEM

(76) Inventor: Lawrence D. Rosenthal, 6845 Aitken Dr., Oakland, CA (US) 94611

( * ) Notice: Subject to any disclaimer, the term of this patent is extended or adjusted under 35 U.S.C. 154(b) by 0 days.

This patent is subject to a terminal disclaimer.

(21) Appl. No.: 10/082,880

(22) Filed: Feb. 26, 2002

Related U.S. Application Data

(62) Division of application No. 09/653,388, filed on Sep. 1, 2000, now Pat. No. 6,366,202.
(60) Provisional application No. 60/152,691, filed on Sep. 7, 1999.

(51) Int. Cl.[7] ..... G08B 1/08
(52) U.S. Cl. ..... 340/539; 340/568.7; 340/572.1; 340/572.8
(58) Field of Search ..... 340/568.7, 539, 340/572.1, 572.8, 692, 825.36, 825.49, 384.1

(56) References Cited

U.S. PATENT DOCUMENTS

| | | | | |
|---|---|---|---|---|
| 3,970,987 | A | 7/1976 | Kolm | 340/15 |
| 4,101,873 | A | 7/1978 | Anderson et al. | 340/539 |
| 4,413,198 | A | 11/1983 | Bost | 310/324 |
| 4,476,469 | A | 10/1984 | Lander | 340/825.49 |
| 4,507,653 | A | 3/1985 | Bayer | 340/539 |
| 4,922,229 | A | 5/1990 | Guenst | 340/572 |
| 5,204,657 | A | 4/1993 | Prosser et al. | 340/568 |
| 5,294,915 | A | 3/1994 | Owen | 340/539 |
| 5,298,833 | A | 3/1994 | Pilney et al. | 340/573 |
| 5,450,070 | A | 9/1995 | Massar et al. | 340/825.35 |
| 5,638,050 | A | 6/1997 | Sacca et al. | 340/571 |
| 5,673,023 | A | 9/1997 | Smith | 340/571 |
| 5,677,673 | A | 10/1997 | Kipnis | 340/539 |
| 5,677,675 | A | 10/1997 | Taylor et al. | 340/568 |
| 5,680,105 | A | 10/1997 | Hedrick | 340/571 |
| 5,686,891 | A | 11/1997 | Sacca et al. | 340/571 |
| 5,859,585 | A | 1/1999 | Fleming | 340/539 |
| 5,926,090 | A | 7/1999 | Taylor et al. | 340/568.1 |
| 5,939,981 | A | 8/1999 | Renney | 340/539 |
| 5,945,918 | A | 8/1999 | McGonigal et al. | 340/825.36 |
| 5,949,328 | A | 9/1999 | Latty | 340/326 |
| 5,999,799 | A | 12/1999 | Hu et al. | 455/67.7 |
| 6,012,029 | A | 1/2000 | Cirino et al. | 704/275 |
| 6,084,517 | A | 7/2000 | Rabanne et al. | 340/573.4 |

OTHER PUBLICATIONS

Murata Electronics, "Piezoelectric Sound Components", *Murata PZT Application Manual*, date unknown, pp. 84–91.

*Primary Examiner*—Daryl Pope

(57) ABSTRACT

A lost item finding system including at least two nearly identical locators. Either one can be used to find the other and whatever items are attached to it. The available locator broadcast to the lost one an acoustic search signal including a sequence of tones having predetermined frequency differences between them. The lost locator determines the baseline frequency and then identifies whether the signal conforms to the predetermined tone sequence and then transmits a beacon signal that can be perceived by the user as he searches for the lost item. The beacon signal may include both an audible signal and a flashing light emitting diode. Advantageously, both the transmission and reception of the audio signal is accomplished with one piezoelectric transducer, and the efficiency of the transducer is increased by forming a resonant cavity having a cap both protecting the piezoelectric transducer and forming an annular side port.

22 Claims, 8 Drawing Sheets

ACOUSTIC FINDING SYSTEM

RELATED APPLICATION

This application is a division of U.S. application Ser. No. 09/653,388, filed Sep. 1, 2000, now issued as U.S. Pat. No. 6,366,202, and also claims benefit of U.S. provisional application, Serial No. 60/152,691, filed Sep. 7, 1999.

FIELD OF THE INVENTION

The invention relates generally to systems for finding lost objects. In particular, the invention relates to paired devices, particular those employing acoustic search signals, for finding the lost one of the pair.

BACKGROUND ART

It is common in personal and business life to lose small items in a relatively small area. A common example is a set of personal keys including keys for a personal automobile and probably for home and business. Automobile manufactures invariably supply duplicate sets of keys. The car owner usually carries one set in a pocket or purse and leaves the other set in a known location such as a key rack or storage container. If the primary set is misplaced, typically in process of changing clothes or emptying pockets or purses, the other, secondary set is usually readily available. However, the key owner usually wants to find the primary set, both because of the other keys attached to the key ring but also to assure that the secondary set is not subsequently also lost. Typically, the lost set of keys is known to be in a relatively restricted area, for example, at home in one of two or three rooms, since the lost keys were most probably used to drive home and open the door. Thereafter, their whereabouts in the home may be uncertain. As a result, the search for the missing keys needs to cover only a limited area, but the owner is usually in a rush to leave and wants to find them immediately. Similar limited-area searching is often required for eyeglass cases, television remotes, security badges, and the like.

SUMMARY OF THE INVENTION

A lost item finding system may comprise two or more identical or nearly identical locators. Transmission of a search signal from one of the locators causes one or more of the other locators to emit a beacon signal, such as an audible signal and a flashing light, enabling the user to locate the lost locator and attached items. The locators may substantively differ only in a programmed identification code used for either transmitting and/or receiving the search signal.

A preferred embodiment uses an acoustic transducer, for example, a piezoelectric transducer, to receive an acoustic search signal, to transmit a corresponding acoustic search signal, and to transmit an audible beacon signal. In transmission mode, the piezoelectric transducer may be subjected to bipolar pulsing across its two inputs. In reception mode, one input is left floating and connected to amplifying, pulse shaping, and counting circuitry while the other input is held at a fixed potential.

The acoustic transducer may be coupled to a Helmholtz resonant acoustic cavity tuned to the resonant frequency of the piezoelectric element, preferably having an annular output port coupled to a cylindrical cavity. A cap may both define the end of the cavity and be spaced from the case enclosing the cavity to form the annular output port.

Preferably, each locator can be selectively disabled, allowing two locators to perform the responding and beaconing without interference from additional locators.

The acoustic search signaling transmission and detection may be arranged to minimize the effects of ambient noise to allow operation in particularly noisy environments. The search signal may consist of a sequence of tones having well defined frequency differences and separated by quiet periods. The detection of the search signal on one hand may require the detection of a quiet period following the tone sequence but on the other hand may respond to multiple transmissions of the tone sequences in a noisy environment.

The baseline frequency, the first tone of the tone sequence, may preferably be any frequency in a broad range, and the detection circuitry nonetheless can detect the tone sequence by determining the frequency differences of the tones relative to the baseline frequency.

DETAILED DESCRIPTION OF THE PREFERRED EMBODIMENTS

Figure 1:
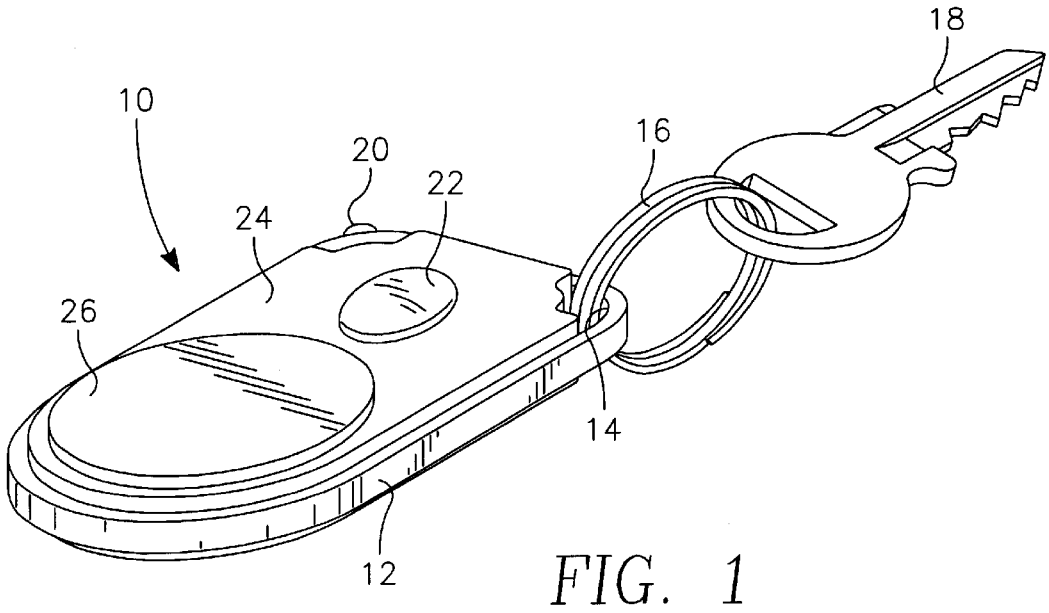
FIG. 1 is a perspective view of one embodiment of the lost item locator of the invention.

FIG. 1 is a perspective illustration of an embodiment of a locator 10 to be used in the lost item finding system of the invention. The locator 10 includes a molded plastic case 12 enclosing the electronics and audio transducer to be described later. The case 12 is approximately 5 cm long, 3 cm wide, and 1 cm thick so that it can be easily carried in a pocket or purse. The case 12 includes a loop 14 at one corner around which can be wrapped a key ring 16 holding one or more keys 18. However, other items may be attached to the case 12, such as a television remote or security badge among many other possible items which tend to be misplaced. A light emitting diode (LED) 20 protrudes from another comer of the case 12 and selectively emits a visible signal. A switch button 22 attached to a normally open switch is accessible on one flat side 24 of the case for convenient finger activation. A disk-shaped cap 26 is spaced by a small distance from the flat side 24 of the case 12 and is supported thereon by three unillustrated legs. The cap 26 protects an acoustic transducer under it and also forms one side of an acoustic resonator to be described later.

Figure 2:
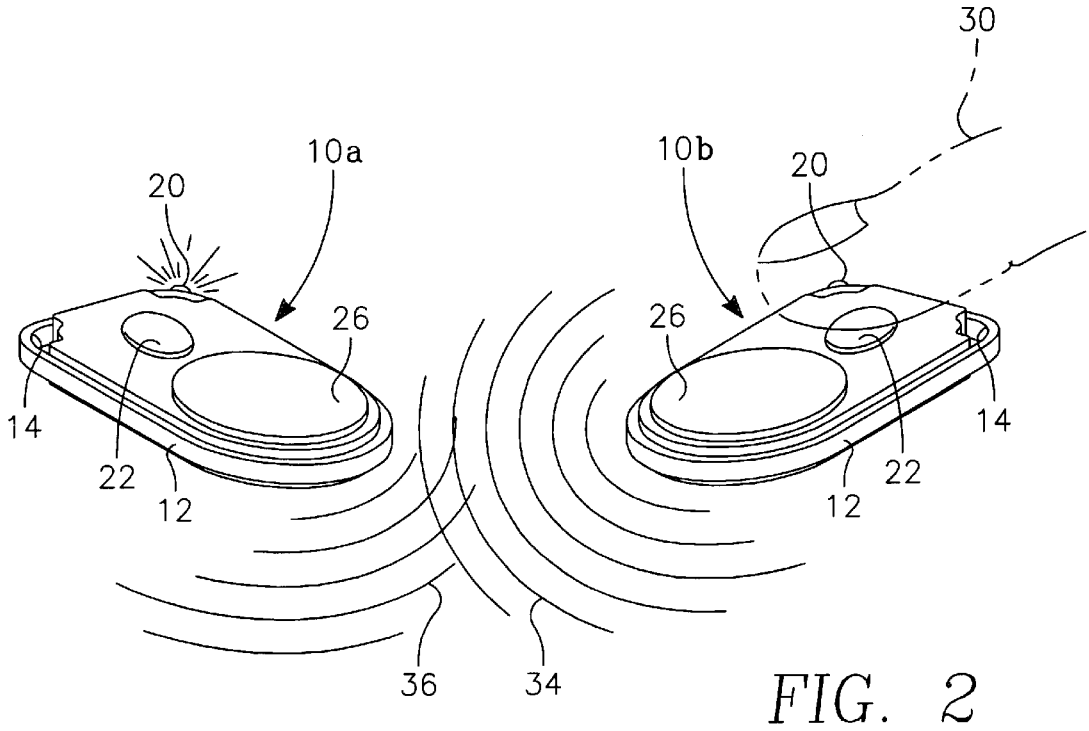
FIG. 2 is a schematic representation of the operation of the paired locators of the invention for finding one of them attached to lost items.

Two such locators 10*a* and 10*b* illustrated in perspective in FIG. 2 form a lost item finding system. One locator 10*a* is assumed to be misplaced along with its attached key or similar item while the other locator 10*b* is assumed to be readily available from, for example, a key rack or security box. The attached items are not shown, but they may be the primary and spare key set or a house key and a television remote, either of which is subject to being misplaced. When the user decides that the first locator 10*a* and attached item is lost, he finds the second locator 10*b* and presses the button 22 with his finger 30. The second locator 10*b* emits a coded acoustic signal 34, which is detected by the lost first locator 10*a*. In response, the lost first locator 10*a* emits another audible acoustic signal 36 and a visible optical signal from its LED 20, which enable the user to locate the lost first locator 10*a*. Preferably, the two locators 10*a*, 10*b* are nearly identical so that either one can be lost and then found by activating the other one.

Figure 3:
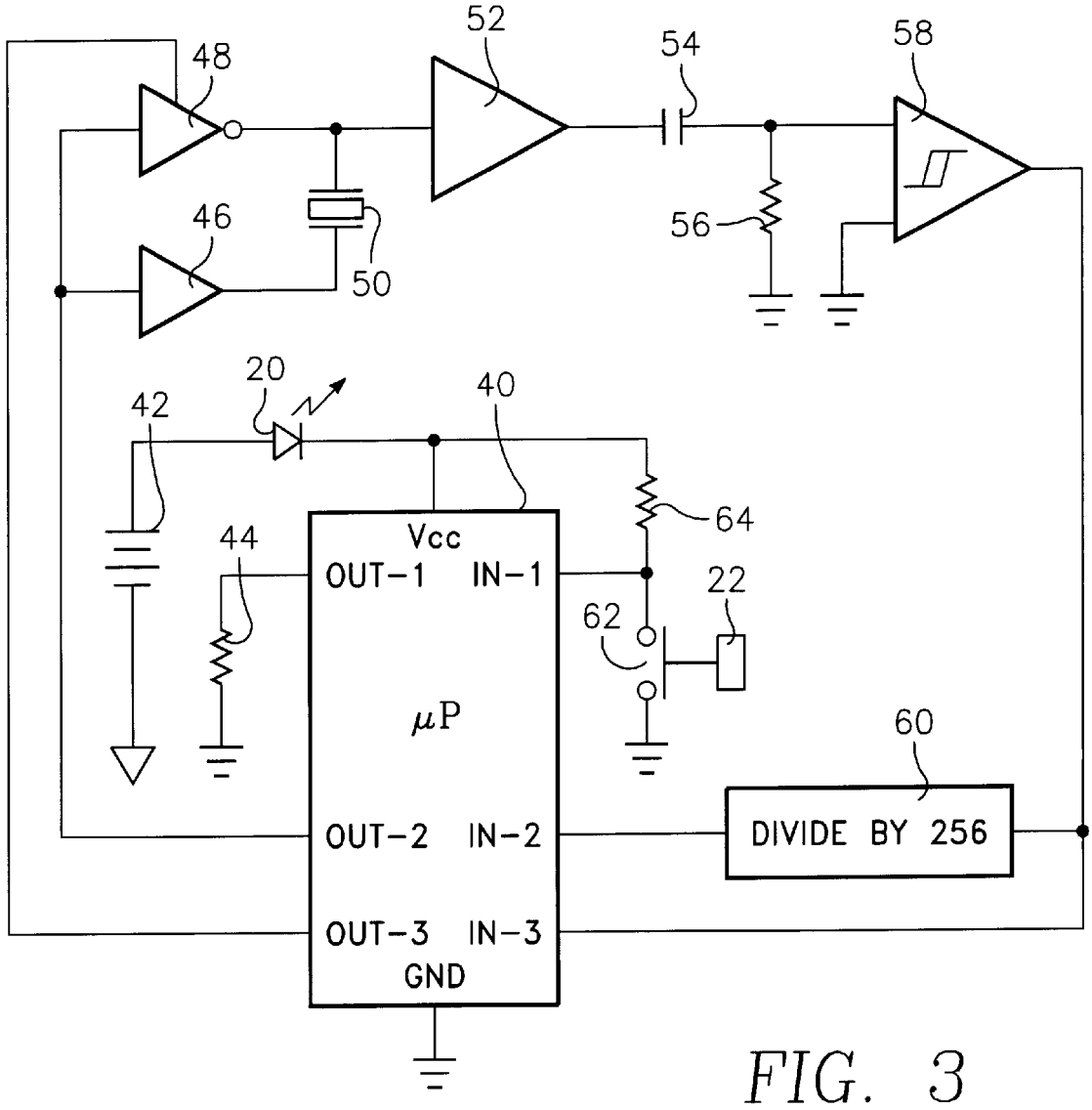
FIG. 3 is a simplified schematic diagram of the electronic circuitry usable with an audio embodiment of the invention.

A simplified schematic diagram of the electronics contained in the case 12 is illustrated in FIG. 3. The illustrated items are soldered to a printed circuit board shaped to fit inside of the case 12. A programmable microprocessor 40, such as a 12C509A available from Microchip Technology, forms the controller of the locator 10. Two serially connected 3V batteries form a DC power supply 42 connected to the power input $V_{cc}$ of the microprocessor 40 through the LED 20. The microprocessor 40 is designed to operate from a DC power source providing between 3 and 5.5V. In order to provide a voltage in the middle of the operating range, the LED 20 drops the 6V of battery voltage to 4V at the power input $V_{cc}$ of the microprocessor 40. In sleep mode, the microprocessor 40 consumes only about 1 $\mu$A of current while in active mode it consumes about 1 mA of current. The locator 10 stays in sleep mode until its button 22 is activated or it hears an acoustic signal.

The microprocessor 40 has three outputs OUT-1, OUT-2 and OUT-3. The first output OUT-1 connects to a load resistor 44 connected to ground. When the first output OUT-1 goes high, current flows out of the microprocessor 40 through that output, and corresponding additional current flows into the microprocessor power input $V_{cc}$ through the LED 20 causing it to emit additional light. The second output OUT-2 is connected to the inputs of both a buffer 46 and an inverting tri-state buffer 48, both of which may be formed from a 74HC125 quad tri-state buffer and a resistor. The buffer 46 simply outputs a high-power signal corresponding to its low-power input while the inverting tri-state buffer 48 either outputs a high-power signal inverted from its low-power input or presents a high-impedance output depending upon the signal from the third output OUT-3 from the microprocessor 40. A piezoelectric audio transducer 50, such as available from Murata Electronics, is connected across the outputs of the buffer 46 and the inverting tri-state buffer 48. Assuming that the microprocessor 40 has activated the inverting tri-state buffer 48 with its third output OUT-3, the outputs of the two buffers 46, 48 are complementary, either 0 or 6V, with the polarity determined by the signal from the microprocessor's second output OUT-2. The bipolar signal driving the transducer 50 generates a louder audio signal as the piezoelectric unit is driven in both directions. For audio signaling, this output OUT-2 is switched at a frequency in the range of 5.5 to 7.5 kHz, with the effect that the audio transducer emits an audio signal in this frequency range.

However, in sleep mode or other periods in which the microprocessor 40 is awaiting reception of an audio signal, the microprocessor's third output OUT-3 inactivates the inverting tri-state buffer 48 to its high-impedance output mode and its second output OUT-2 goes low, thus grounding the other side of the audio transducer 50. In this state, the audio transducer 50 can detect an audio signal and convert it to an electrical signal which is amplified by amplifier 52. That is, the transducer 50 can act both as an audio transmitter and audio receiver. The detected audio signal, presumably also at 5.5 to 7.5 kHz, is amplified by amplifier 52 and then filtered by a low-pass filter including a serially connected capacitor 54 and a grounded resistor 56 which removes any DC bias. The audio signal with any DC bias removed is input to a comparator 58 having hysteresis so that any low-level noise is ignored and the generally sinusoidal detected audio signal is converted to a square wave more amenable to digital processing. Each cycle of the square wave amounts to a pulse within the digital circuitry.

The output of the hysteretic comparator 58 is input to a third input IN-3 of the microprocessor 40 and to a divide-by-256 circuit 60, which may be a 74HC393 dual 4-bit counter with the high-order output bit, which changes state every 128 pulses, treated as the output of the divider 60. The divider output is connected to a second input IN-2 of the microprocessor 40. The third microprocessor input IN-3 serves as a received data input that allows the microprocessor 40 to analyze the received audio signal and determine whether the audio signal is from the paired locator seeking to find the lost locator with the illustrated circuitry. The divide-by-256 circuit 60 provides one method of waking up the microprocessor 40 after 128 input pulses of the external audio signal (20 ms for a 6500 Hz signal) have been detected to further determine if the detected audio signal is coded to form a locating signal from the other locator. Using an algorithm to be described in more detail later, if it is determined that a correctly coded audio signal has been received, the microprocessor 40 causes the LED 20 to flash and the audio transducer to emit an audio signal that can be heard by the user.

The circuitry of FIG. 3 does not illustrate common elements, such as transistors, resistors, and capacitors that form the amplifier 52 and power supply leads connected to the non-processor active elements.

The microprocessor 40 is also woken up, if it is asleep, by a low signal applied to its first input IN-1 produced when a normally open switch 62 mechanically connected to the button 22 is closed. The switch 62 is electrically connected between ground and the input IN-1, also serially connected through a resistor 64 and the LED 20 to the power supply 42. When the input IN-1 is activated, the microprocessor 40 causes the audio transducer 50 to emit a coded sequence of audio tones in the range of 5.5 to 7.5 kHz. However, as will be described in reference to the programmed algorithm, the button can be activated in particular ways to cause the locator to perform other functions.

In view of the limited power from small batteries and the possibly noisy ambient environment, it is important that the audio transducer be as efficient as possible both for transmission and reception. The bipolar pulsing with the complementary outputs of the two buffers 46, 48 increases the signal generating ability. Further efficiency is achieved with a Helmholtz resonator similar to that disclosed in the document published by Murata Electronics entitled "Piezoelectric Devices Application Manual," pp. 84–91. As illustrated in the plan view in FIG. 4 and the cross-sectional view of FIG. 5 taken along view line 5—5 of FIG. 4, an upper half case section 70 is formed with a cylindrical cavity 72 between a downwardly projection tubular wall 74 terminating in a sharp annular ridge 76. The piezoelectric transducer 50 includes an integral assembly of a 20 mm brass disk 80, a piezoelectric ceramic layer 82, and a flexible silver electrode layer 84 are fixed to the annular ridge 76 with a flexible adhesive. Unillustrated electrical contacts are made to the brass disk 80 and the silver layer 84 to allow the circuitry of FIG. 3 to apply a voltage across the piezoelectric ceramic layer 82. The resultant lateral contraction or expansion of the piezoelectric layer 82 causes it and the brass disk 80 to flex alternately convexly and concavely, thus launching a sound wave. Alternatively, if an externally generated sound wave flexes the piezoelectric assembly, a voltage signal is generated between the two contacts in proportion to the intensity of the sound wave. The piezoelectric transducer 50 is mounted to the annular ridge 76 at a vibrational node of transducer 50, at a diameter at which no vibration occurs. This mounting method causes the least mechanical suppression of vibration and thus provides for the highest efficiency of the transducer.

The cavity 72 together with the sound port 86 to the surrounding environment form a Helmholtz resonator. The dimensions of the cavity 72 and the sound port 86 determine the frequency of the resonator, here around 6500 Hz. The Helmholtz resonator is a harmonic oscillator and can be analogized to a weight attached to a spring, both of which can be described by the same equations. The air in the inner cavity 72 compresses and expands analogously to the motion of a spring, and the air in the sound port 86 is pushed back and forth and is analogous to the weight. Note that the Helmholtz resonator functions only when the cube root of the volume of the cavity 72, the square root of the area of the sound port 86 at the interface to the cavity 72 and the effective length of the sound port 86 are all significantly less than the wavelength of the sound at the resonant frequency.

Prior-art Helmholtz resonators used in conjunction with piezoelectric transducers use a single circular port above the cavity 72. Such a structure has two disadvantages for a lost item finder. If the single sound port for the Helmholtz resonator is lying on a surface face down, or for example, sandwiched between two pillows on a sofa, the resonant characteristics of the resonator will be adversely altered and the emitted sound will be significantly blocked. Further, the intensity of the sound directly in front of the sound hole of the conventional Helmholtz resonator is very loud, and it can even be painful to someone who might place it directly up to his ear. To overcome these problems, the resonant cavity 72 is preferably covered with a cap 26 spaced from the case half 70 by three unillustrated standoffs so as to form a sound port that is an annular channel 86 of predetermined height and length, where the height of the cap 26 and dimensions of the cavity 72 are chosen to form a resonant system that resonates at 6500 Hz.

I have derived an approximate formula for the resonant frequency of the cavity $$f_0 = \frac{c}{2\pi}\sqrt{\frac{4g}{1.3dh(g+\sqrt{dg})}},$$

where c is the velocity of sound ($3.44\times10^4$ cm/s at 24° C.), d is the diameter of the cavity 72, g is the gap between the outer face of the cavity 72 and the cap 26, and h is the height of the cavity 72. Exemplary values are d=1.27 cm, g=0.102 cm, and h=0.381 cm, which imply that the resonant frequency $f_0$ is 6488 Hz.

Figure 4:
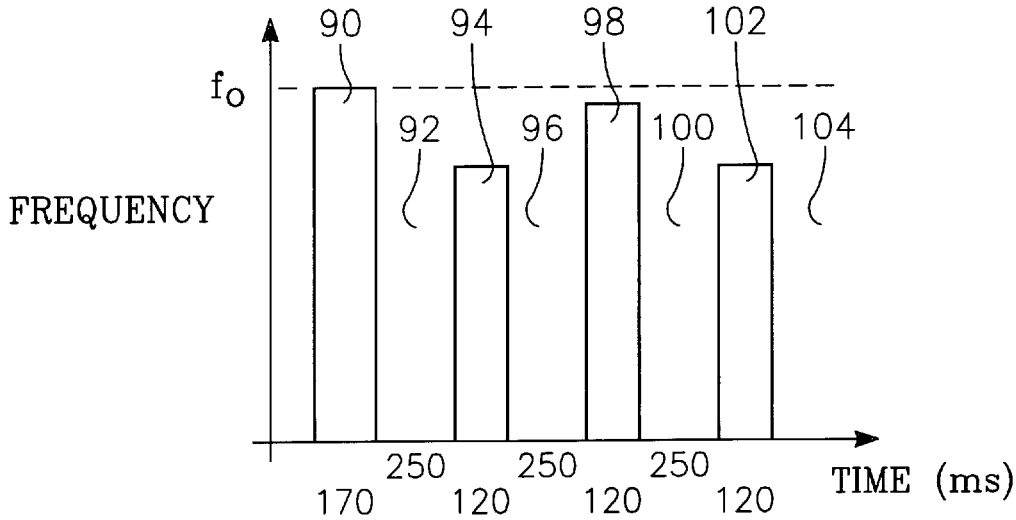
FIG. 4 is a partial plan view of the section of a case of FIG. 1 including the audio transducer cavity.
Figure 5:
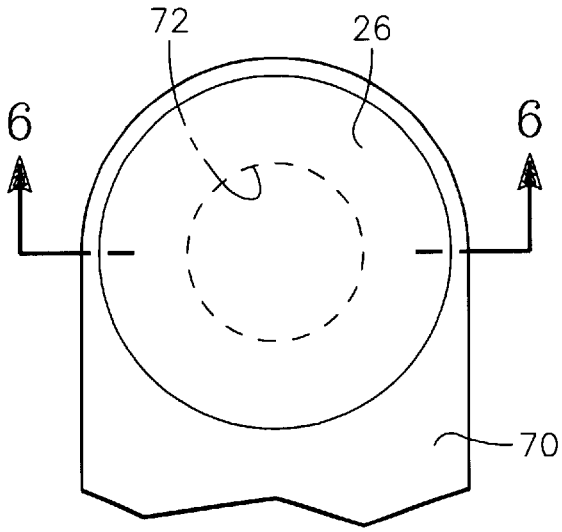
FIG. 5 is a cross-sectional view of the audio transducer cavity taken along view line 5—5 of FIG. 4.

With the structure for the Helmholtz resonator of FIGS. 4 and 5, the sound is much less likely to be blocked because it is emitted in a 360 degree pattern parallel to the face of the device. Further, the maximum sound intensity immediately in front of the improved resonator is significantly less than that immediately in front of a comparably efficient prior-art resonator. In one experiment the prior-art device and the improved device were found to generate the same intensity sound at a distance of 5 centimeters and beyond. At a distance of 0.5 centimeters, however, the improved device generated a sound pressure level that was 15 dB quieter than the prior-art device. Furthermore, the cap 26 protects the piezoelectric element 50 from being damaged by foreign objects.

The finding system of the invention can be programmed to operate in a number of different modes. The programming may be accomplished by coding the necessary instructions in the assembly language of the microprocessor and impressing those instructions in machine code form into the non-volatile memory of the microprocessor 40.

Figure 6:
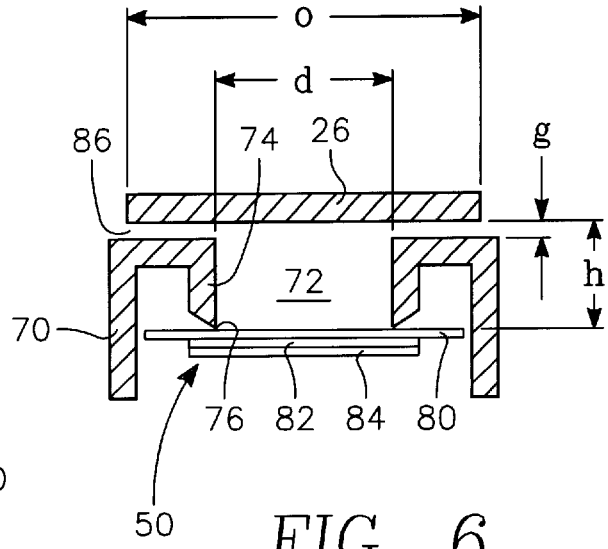
FIG. 6 is a timing diagram of the sequence of audio tones used for searching.

One set of operating procedures will now be described based upon a coded sequence of tones schematically illustrated in FIG. 6. The tone sequence is used to communicate a search signal from the available locator to a lost locator. Each audio tone is at a fixed frequency and of finite duration. A single such tone sequence can in many circumstances be sufficient for finding the lost locator, but it is anticipated that the user will repetitively activate the locator's transmitter for yet further such sequences. Once the lost locator has verified that the coded sequence has been received, it emits both an acoustic and an optical signal acting as beacons to the user attempting to find the lost locator. A baseline frequency $f_0$ is assumed to exist in the 5500 to 7500 Hz range. Audio signals in this range can be efficiently generated and received within a small case. Its precise value may depend upon environmental and aging effects of the transducer and its electronic controls. An inexpensive RC clock internal to the microprocessor 40 is accurate to no more than ±10% so timing between multiple locators must accommodate such variations. Further, a procedure is available to change the baseline frequency to one found to be most sensitive in actual use. The lost locator however, should be able to detect the coded tone sequence regardless of the baseline frequency $f_0$ as long as it is within the permitted range.

The tone sequence includes a first tone 90 at the baseline frequency $f_0$ enduring for 170 ms followed by a first quiet period 92 of 250 ms. A second tone 94 is emitted at a frequency that is 250 Hz below the baseline frequency $f_0$ for a period of 120 ms followed by a second 250 ms quiet period 96. A third tone 98 is emitted at a frequency 50 Hz below the baseline frequency $f_0$ for a period of 120 ms followed by a third 250 ms quiet period 100. A fourth and final tone 102 is emitted at a frequency 250 Hz below the baseline frequency $f_0$ for a period of 120 ms. A long quiet period 104 follows the tone sequence until another such tone sequence is transmitted as a further search signal.

This coded sequence is advantageous when operating in a noisy environment including, for example, music, conversation, or other combinations of noise. In such an environment, it is possible that almost any frequency is likely to be detected at some time. The precise frequency shifts, however, are unlikely to be duplicated by background noise. The frequency changes and the relatively long quiet periods also overcome interference resulting from the generated tones echoing for tenths of seconds or more in some rooms.

To further improve the reliability of the locator by accommodating situations where the tone sequence is duplicated by environmental noise, one feature requires that a quiet period be observed at the end of the tone sequence. The requirement that the tone sequence be followed by a quiet period all but eliminates the possibility of false alarms, but it also creates a problem. In noisy environments a locator will not respond to the tone sequence generated by another locator because the quiet period will not be observed. To resolve this problem, the requirement that a quiet period be observed may be temporarily suspended for approximately ten seconds when the tone sequence is recognized but the quiet period is not observed. Temporally removing the required observation of a quiet period does not create a problem, however, because it is very unlikely that any noise source will produce two valid sequences of the search signal in a ten second period. Thus, in a noisy environment the locator will not respond on the first try but it will respond on the second try and each try thereafter as long as each try is within ten seconds of the previous try. Having to press the signaling button more than once is not a problem because this is the normal mode of operation for a person anxious to retrieve a lost item.

The microprocessor 40 may be programmed to perform many different functions. However, an advantageous set of functions is described with respect to the following diagrams.

Figure 7:
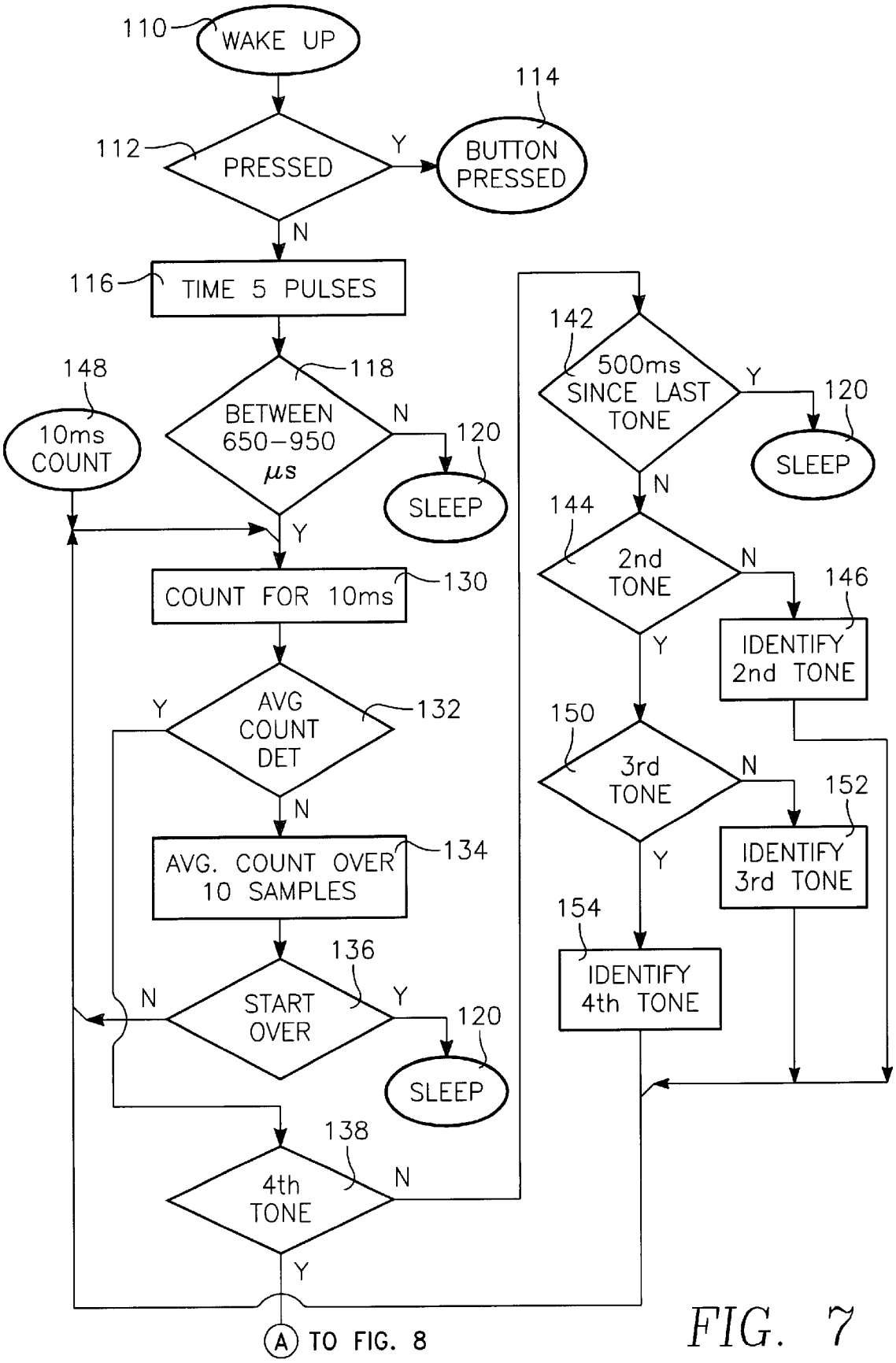
FIGS. 7 and 8 are flow diagrams of an algorithm usable with the electronic circuitry of FIG. 3 and primarily concerned with the operation of a lost locator receiving a search signal and responding with beacon signals.

During periods in which the finding system is not being used, the microprocessor 40 remains in a SLEEP mode consuming very little power and doing little more than awaiting a Wake Up 110, a form of processor reset, as illustrated in the flow diagram of FIG. 7. Wake Up 110 occurs when, during the SLEEP mode, either the microprocessor's IN-1 or IN-2 input changes state in either direction, that is, either the button 22 is pressed or released, or a further 128 pulses have been detected by the divide circuit 60. Signaling data on the IN-3 input does not cause a Wake Up. The microprocessor 40 is also reset when the battery is first installed or replaced. Depending on whether the reset was the result of installing the battery or waking up as the result of an input changing state, different initializations are made to put the microprocessor 40 and other circuitry in the correct state. A test 112 is then made for whether the button 22 is pressed by determining if the IN-1 input is low. If it is, processing is diverted to a BUTTON PRESSED routine 114 to be described later with respect to FIG. 9. If it is not pressed, the time T is measured in step 116 for the receipt of five input pulses on the IN-3 input. If test 118 determines that the time T is not between 650 and 950 $\mu$s, that is, an average frequency of between 5300 and 7700 Hz, then processing returns to the SLEEP mode 120.

If the time T is within specified limits, an initial counting step 130 measures the number of pulses arriving on the third input IN-3 over a 10 ms period. This 10 ms count occurs many times during the receiving algorithm. It is easily implemented knowing how long it takes to execute each instruction in the microprocessor 40. A small loop is executed a fixed number of times while the number of high-low transitions on the third input IN-3 is counted. For a 5500 to 7500 Hz audio signal, the number of counts would be between 55 and 75. While counting the pulses, the time between successive pulses is also measured. At low levels, noise (either acoustic or electronic) can cause a pulse to be missed. Therefore, if the spacing between pulses is between 260 and 350 $\mu$s, twice the expected spacing, the algorithm assumes that a pulse has been missed and it adds a count. If during a 10 ms period the number of missed pulses exceeds seven, the process does not continue to add counts; the pulse train is either too corrupted to be accurately corrected or it is being generated from sounds other than the signaling tone.

Test 132 determines if an average count has already been determined. If it has not yet been determined, in step 134, the average count is determined from the first ten 10 ms counts of step 130. The averaging may advantageously discard the highest three and lowest three counts and average the remaining four counts. If at any time during the averaging process the highest and lowest count differ by more than two counts, a decision is made in step 136, and the processing returns to the SLEEP mode. If a decision to start over is not made, the process returns to step 130 to determine the number of pulses that arrive during the next 10 ms counting period.

If test 132 shows that the average count has been determined, processing skip to step 138. At this point, the first tone has been determined to have been identified, and the value of the average count is determined to correspond to the baseline frequency being used by the sender. Also, a time of so identifying the first tone is saved. Then, test 138 determines if the flag has already been set indicating the identification of the fourth tone. If the fourth tone has been identified so that the full tone sequence has been received, execution transfers to transfer point A in FIG. 8, the start of a routine that is concerned with features for dealing with background noise. If the fourth tone has not been identified, a test 142 determines if more than 500 ms has elapsed since the identification of the previous tone, specifically the first, second, or third tone. If such a long period has elapsed, then the anticipated tone is determined to have not been received and the process is returned to the SLEEP mode 120.

If less than 500 ms has elapsed, then test 144 determines if the second tone has already been identified. If it has not, then step 146 attempts to identify the second tone. The second tone is a tone about 250 Hz lower than the first tone, Therefore, its 10 ms counts must be two or three counts less than the baseline count. The identification of the second tone is successful when four of five sequential 10 ms counts meet the criteria, whereupon a flag is set for the identification of the second tone and the time is saved for when this occurred. Whether or not the second tone has been identified in step 146, processing returns to the 10 ms count entry point 148 leading to the initial counting step 130 to determine the number of pulses that arrive during the next 10 ms counting period.

If test 144 determines that the second tone has already been identified, test 150 determines whether the third tone has been identified. If the third tone has not been identified, step 152 attempts to identify the third tone. The third tone is a tone about 50 Hz lower than the first tone. Therefore, its 10 ms counts must be zero or one counts less than the baseline count. The identification of the third tone is successful when four of five sequential 10 ms counts meet the criteria, whereupon a flag is set for the identification of the third tone and the time is saved for when this occurred. Whether or not the third tone has been identified in step 152, processing returns to the initial counting step 130 to determine the number of pulse that arrive during the next 10 ms counting period.

If test 150 determines that the third tone has already been identified, then step 154 attempts to identify the fourth tone following the same criteria as for the second tone identification 146. When the fourth tone is identified a flag is set for its identification and the time is saved for when this occurred. Whether or not the fourth tone has been identified in step 154, processing returns to the initial counting step 130 to determine the number of pulses that arrive during the next 10 ms counting period.

Figure 8:
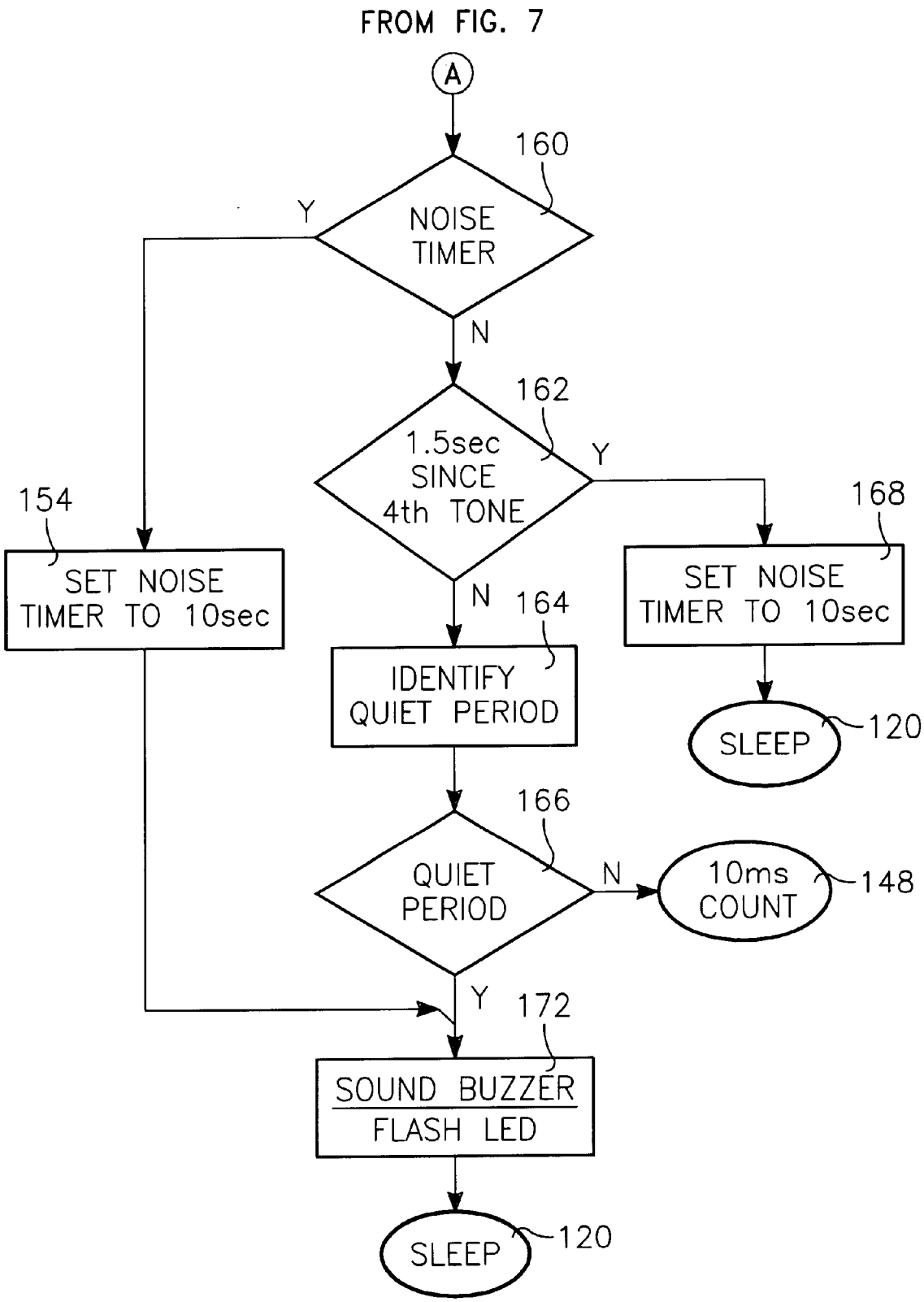

With reference to FIG. 8, transfer point A from FIG. 7 is followed by a test 160 for determining whether a background noise timer remains set, that is, has not expired by being decremented to zero.

If the test 160 determines that the background noise timer is no longer set, a test 162 determines whether a period of 1500 milliseconds has elapsed since the fourth tone has been identified. If 1500 milliseconds have not elapsed, step 164 attempts to identify a quiet period. A quiet period is identified when four out of five sequential 10 ms counts have count values of less than 25. Test 166 determines if a quiet period has been successfully identified. If it has not been, processing returns to the initial counting step 130 to determined the number of pulses that arrive during the next 10 ms counting period. Since the average count has already been determined and the fourth tone has already been identified, test 132 followed by test 138 of FIG. 7 will return to transfer point A with the required 10 ms count.

If test 166 determines that the quiet period has been identified, the search for the signaling sequence has been successfully completed, and step 172 performs the beacon signaling, which preferably includes sounding the audible buzzer implemented with the piezoelectric transducer and flashing the LED for a predetermined length of time of, for example, eight seconds. The audible beacon signal is generated by setting the third microprocessor output OUT-3 to activate the tri-state buffer 48 and outputting a square wave on the second output OUT-2 at the desired audio frequency. The visible beacon signal is generated by outputting a rectangular pulsed signal on the first output OUT-1 at a frequency and duty cycle selected for the flashing LED signal. However, only one of the visible and audio signals are required for the beacon signaling. The frequency of the audio signal may be selected to be most audible to the user but should be within the range that can be handled by the piezoelectric transducer and its associated resonant cavity. After the beacon signaling of step 172, the SLEEP mode 120 is entered.

Returning now to test 160, if the test determines that a background noise time remains set, it is reset back to ten seconds at step 154. Resetting the time back to ten seconds allows sequential search signals, spaced at intervals of less than ten seconds, to be recognized in the absence of a quiet period at the end of each. Thereby, this and subsequent quick button pushes on an available locator will cause the beacon signal from a lost locator to be generated.

If test 162 determines that more than 1500 milliseconds have elapsed since the identification of the fourth tone, the conclusion is that no quiet period has been observed in a reasonable time after the tone sequence has been identified and that the environment is very noisy so that no quiet period is likely to be observed. However, rather than assume that a valid tone sequence has nonetheless been received, the algorithm requires that the user again press the button within a 10 second period. The requirement that the user send out a second set of search tones further reduces the possibility of false recognition. To accomplish this, step 168 sets the background noise timer to 10 seconds and execution returns to the sleep mode 120 awaiting receipt of another tone sequence. Assuming the user does reactivate the identification procedure of FIG. 7 within ten seconds, when processing returns to the noise analysis of FIG. 8, the noise timer will again be reset to 10 seconds.

The process described above with respect to FIGS. 7 and 8 primarily concerns the operation of the lost locator that is being sought by the available locator. The description now turns to the operation of the available locator, the sole activation of which in most circumstances is the pushing of the button by the user. The available locator generates the search signal, but other types of operations are possible, as will be described.

Figure 9:
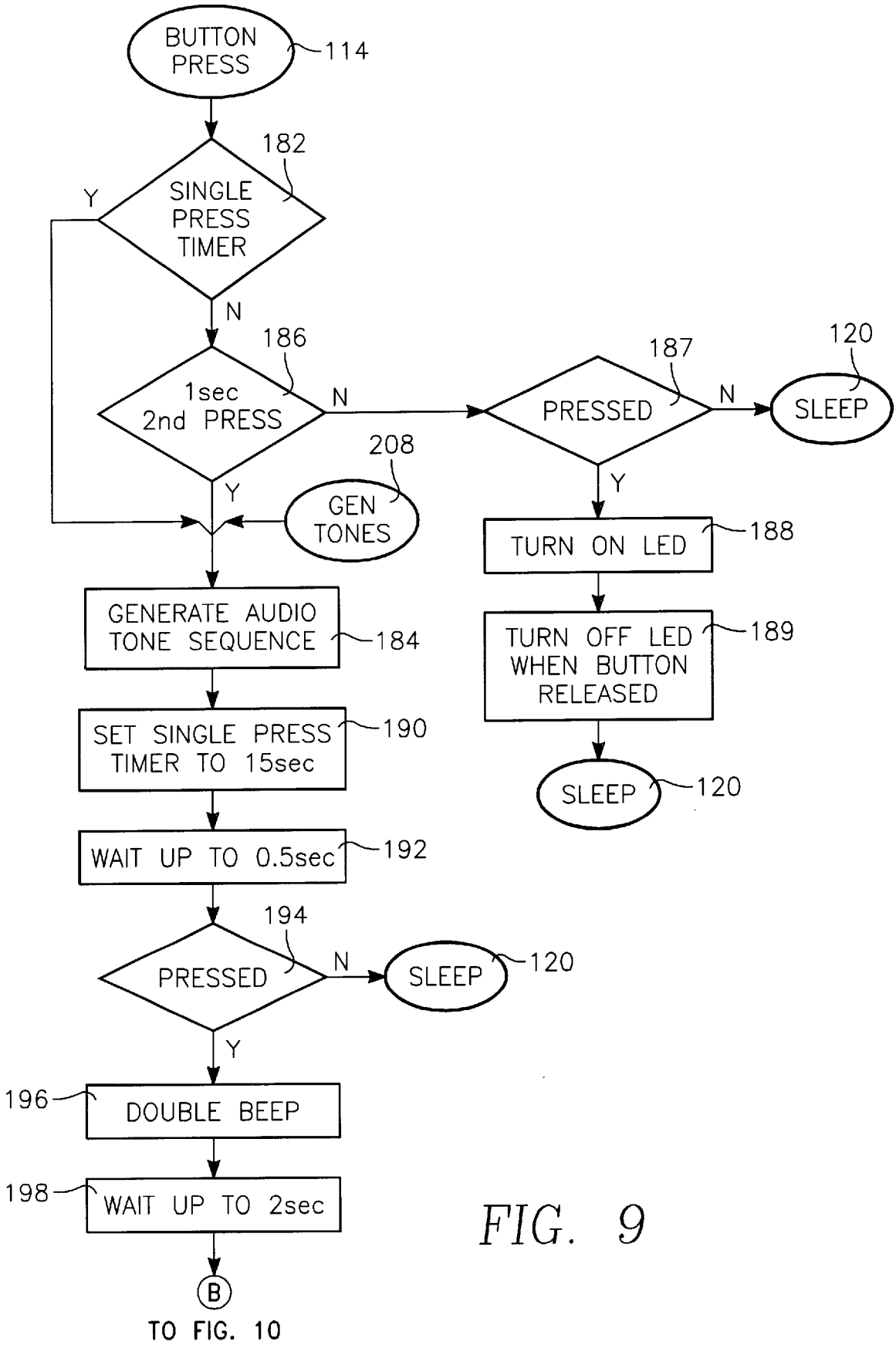
FIGS. 9 and 10 are a flow diagrams of an algorithm complementary to those of FIGS. 7 and 8 usable also with the circuitry of FIG. 3 and primarily concerned with operation of an available locator.

As illustrated in FIG. 9, the process is initiated by the Button Pressed 114 corresponding to the user pressing the button 22 and closing the switch 62 of FIG. 3 to thereby pull the input IN-1 low. This point may have been reached following the Wake Up 110 of FIG. 7 from the SLEEP mode or may be accomplished by a the button 22 being pressed with the microprocessor being in its active mode. Test 182 determines if a Single Press timer remains set and has not expired. The Single Press timer allows a circumvention of the usual system requirement that the button be pressed at least twice within one second to initiate the transmitting of the search signaling tone sequence. The requirement that the button be pressed twice prevents spurious signaling when the locator button is accidentally pushed, for example, as it is jostled in a pocket or purse. If the Single Press timer remains set, indicating that the button was double pressed within the preceding 15 seconds, step 184 generates the audio tone sequence represented in FIG. 6 that constitutes the search signal.

On the other hand, if the Single Press timer was never set or has expired, test 186 determines if the button has been doubled pressed, that is, pressed a second time within one second after the release of the first button press. If it was not again pressed in this short time, test 187 determines if the button is still held down from the first press. If the button is no longer pressed, operation is returned to the SLEEP mode 120. If the button continues to be pressed, step 188 turns on the LED allowing it to be used as a search light to view objects in the dark such as keyholes and the like. Thus, if the user instead of doubling clicking the button to transmit a search signal, instead presses the button down and holds it down, the LED acts as a flashlight for the duration of the button being held down. In step 189, when the button is released, the LED is turned off, and operation is returned to the SLEEP mode 120.

Returning now to test 186, if the button was pressed twice within one second, step 184 generates the audio tone sequence of the search signal. In step 190, the Single Press time is set to 15 seconds. Step 192 is a wait state of up to 0.5 seconds if the button remains pressed. After the 0.5 second wait, test 194 determines if the button continues to be pressed. If it is not pressed, operation returns to the SLEEP mode 120, during which a further pressing of the button will return operation to the Button Pressed point 114 at the beginning of FIG. 9.

Figure 10:
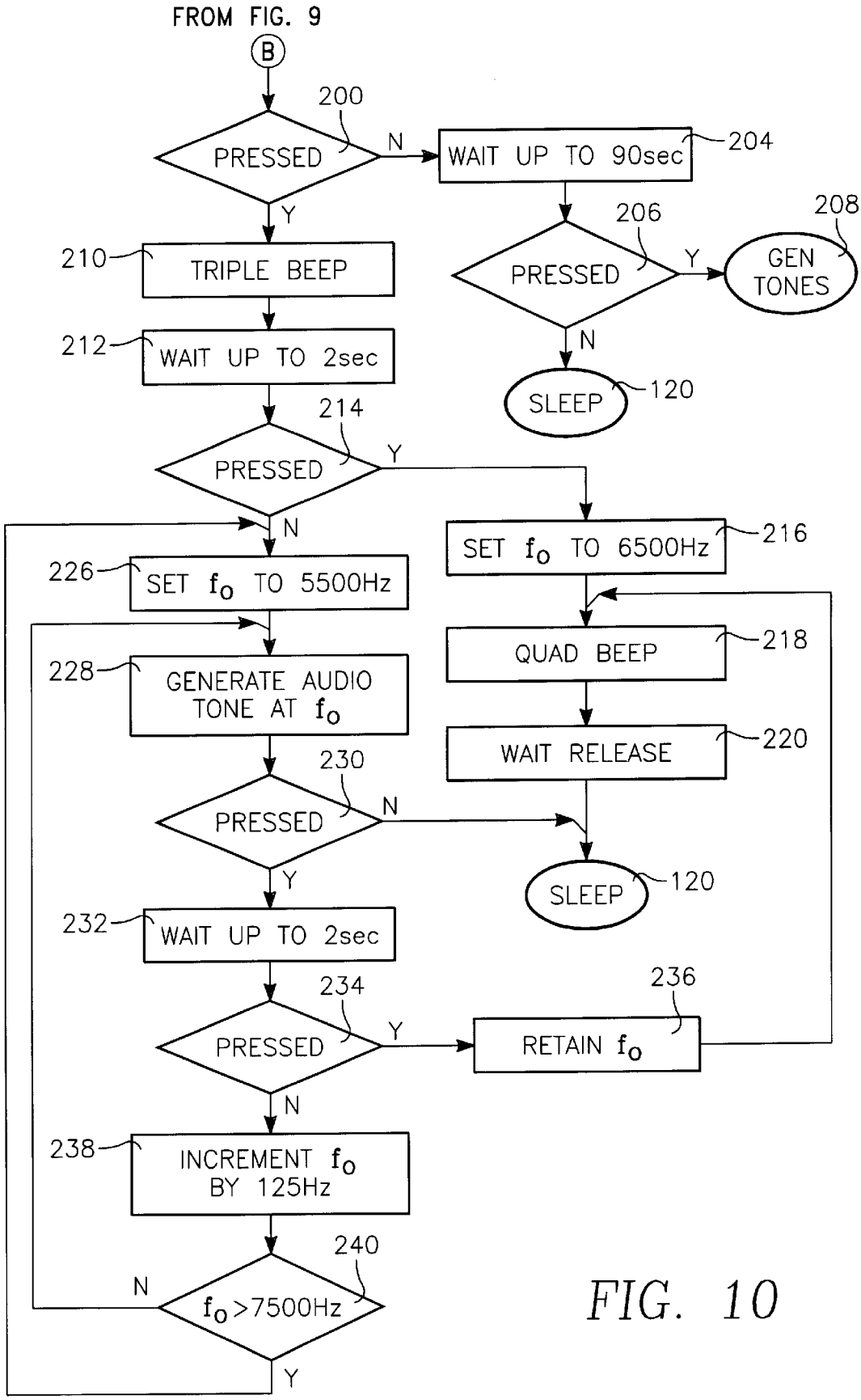
Figure 11:
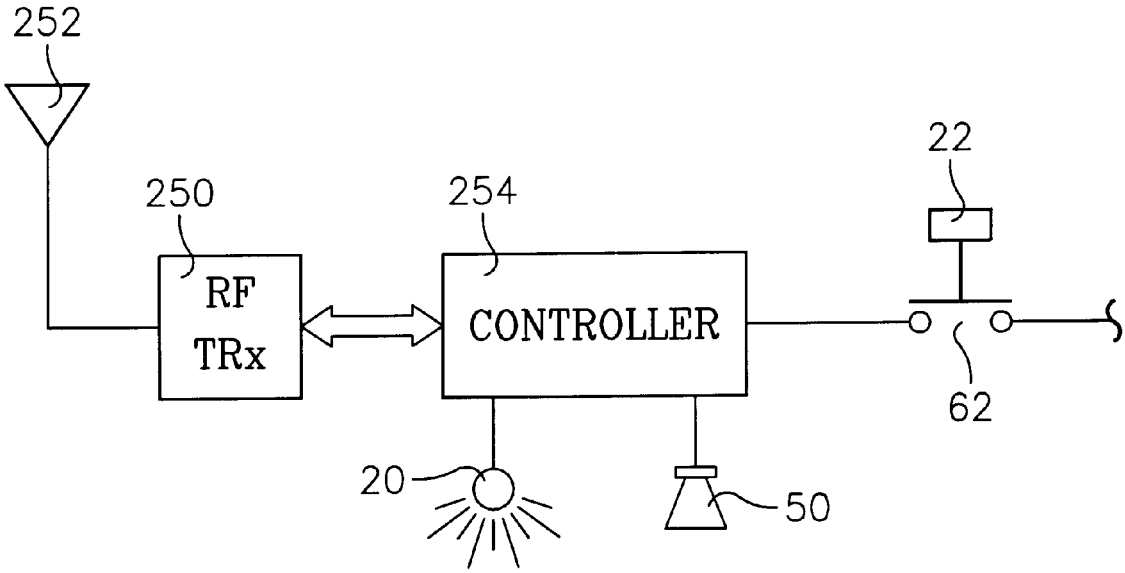
FIG. 11 is a schematic diagram of a locator using an RF search signal.

If the button continues to be pressed in test 194, step 196 generates a short double beep tone to warn the user that he needs to make a decision during the next two seconds. Step 198 waits up to 2 seconds while the button continues to be pressed. Test 200, illustrated in FIG. 10, then determines if the button continues to be pressed. If the user has released the button so it is not pressed, the locator is placed in a 90 second wait state 204 waiting for the button to again be pressed. During this time, the associated locator is inactive even to the receipt of search signals. This 90 second wait is useful in inactivating a third locator while a first locator is searching for a second locator. Responses from the third locator would result in two beacon signals from the second and third locator which would frustrate the search for the lost second locator. If at any time during the 90 seconds the button is pressed, test 206 determines the current state. If it is pressed, operation transfers to a Generate Tones point 208 just before the step 184 for generating the audio tone sequence of the search signal. This allows the user to use the unit before 90 seconds has elapsed. During those 90 seconds, it would be very disconcerting for the user to press the button and hear no response. The 90 second wait should be sufficient for the first locator to find the second locator. If the button, on the other hand, is not pressed during the 90 second deactivation period, operation returns to the SLEEP state 120.

If the user has continued to press the button after the two second wait 198, the test 200 is positive, and step 210 generates a short triple beep tone sequence. The short triple beep notifies the user that he needs to make a decision during the next two seconds in regards to a frequency calibration procedure for setting the baseline audio frequency $f_0$. Step 212 waits up to 2 seconds while the button continues to be pressed. Test 214 then determines if the button continues to be pressed. If it is pressed, step 216 sets the baseline audio frequency to 6500 Hz, the middle of the resonant frequency range of the piezoelectric transducer and its associated resonant cavity. Then, step 218 generates a short quadruple beep tone to indicate to the user that the baseline frequency has been reset to the default value of 6500 Hz. A wait release state 220 is continued until the button is released, and thereafter operation returns to the SLEEP mode 120.

If, on the other hand, the user released the button during the two second wait 212, test 214 is negative resulting in step 226 setting the baseline frequency to an interim value of 5500 Hz. The tone at the interim baseline frequency is generated for up to 10 seconds or until the button is pressed. Test 230 determines whether the button is pressed. If it is not, operation returns to the SLEEP mode 120, and the interim baseline frequency is ignored and the old value of the baseline frequency is retained.

If test 230 shows that the button is pressed, another wait state 232 is entered, following the cessation of the audio tone at the interim baseline frequency, where it will wait up to seconds while the button continues to be pressed. During this period, the user must decide if he is satisfied with the interim baseline frequency or wishes to cycle through the remaining available frequencies. Test 234 determines if the button continues to be pressed. It if continues to be pressed after two seconds, step 236 converts the interim baseline frequency to the permanent one. Operation transfers to the quadruple beep step 218 awaiting release of the button and transfer to the SLEEP mode 120.

If, however, the user released the button during the 2 second wait period 232, test 234 is negative and step 238 increments the interim baseline frequency by 125 Hz. Test 240 determines whether the incremented value is greater than the maximum permitted value of 7500 Hz. If it is not above 7500 Hz, operation returns to step 228 for generating the audio tone at the newly incremented value of the interim baseline frequency. If the increment value is above 7500 Hz, operation returns to the frequency initialization step 226, which resets the interim baseline frequency to 5500 Hz and continues the frequency setting sequence.

The baseline frequency $f_0$ may be reset by this procedure to increase the sensitivity of the lost locator to the search signal. Note that if the piezoelectric transducer and its associated resonant cavity were guaranteed to exhibit peak performance around 6500 Hz and the clocks in the microprocessors where guaranteed to all run at close to the same frequency, the described calibration procedure would be unnecessary. In actuality, both the piezoelectric transducer and its associated resonant cavity as well as the clock in the microprocessor have tolerances no more precise than ±10%. When using the default baseline frequency of 6500 Hz, almost all units will work, however, the operating range in some instances can be improved by changing the frequency. Note that even the 6500 Hz default frequency will vary from locator to locator because the clocks in the microprocessors that control the tone generation will vary in frequency.

It is understood that the above described algorithm does not include many of the details of initialization, synchronization, and timing. However, these are standard issues easily addressed by a programmer of ordinary skill.

As described, any one of thousands of locators manufactured according to the described embodiment can be used in conjunction with any other of the many locators. Although this feature simplifies the manufacture, inventory, and distribution of the locators, an interference problem may arise if the locating system is widely used by many different parties in a close space. For example, multiple users using the system to locate coats in a restaurant coat room. The described system does not differentiate between different users. However, it is possible to set up more complex search signaling algorithms. For example, a longer sequence of tones may be used in which the frequency changes are programmed differently between a significant number of users. This could be accomplished by an 8-bit toggle switch embedded in each locator and changeable by the user to allow 256 different tone sequences. A means could also be provided to program different tone sequence codes into erasable non-volatile memory embedded in each locator.

The use of acoustic search signaling is advantageous in not needing to meet any government standards for electromagnetic emission. Such acoustic signaling can thus be advantageously applied to other types of finding systems in which the search unit and the beaconing unit have different designs with no ability to perform the other function.

The paired object locating system of the invention is not limited to using acoustic energy to signal a lost locator. Another approach has the paired locators using radio frequency (RF) signaling techniques such as are commonly used in garage door openers and automobile door remotes. During manufacture or in the field, the coding information for use by both the transmitter and receiver would be encoded into two or more matched locators so that an encoded RF signal emitted by one of them is recognized by any other of them. For example, as illustrated schematically in FIG. 10, an RF transceiver 250 is connected to an antenna 252 for both transmission and reception of a search signal. A controller 254 programmed with algorithms similar to those described for the acoustic finding system both controls the RF transceiver 250 and receives signals from it. Manual activation of the button controlled switch 62 connected to the controller 254 causes it to instruct the RF transceiver 252 to transmit an RF signal coded according to an identification code provided by the controller 254. When such an RF search signal is received by an associated locator, its RF transceiver 250 transfers the coded message to its controller 254, which checks whether the identification code is a match. If it is not, the search signal is ignored. If it is the same code, the controller 254 broadcasts beacon signals on the LED 20 and the audio transducer 50. Of course, the RF identification codes may be more complex. Two different codes may be paired between two locators, or one locator may be selectively activated to find only one of several other locators.

It is of course appreciated that the locators can be incorporated as integral parts into other similarly sized items. For example, many automobiles are now sold with remote entry systems having a pocket remote key fob for locking and unlocking the car doors and the like, and usually two such remotes are supplied with the car. The locators of the invention can be incorporated into such remotes. Some car keys are intelligent in that they have embedded RF identification chips and RF transmitters for added security in starting the car. Again, the locator of the invention may be incorporated into the already enlarged head of the intelligent key. Also, the car key code may be used as the search code for the finding system.

The invention as described combines simple, compact, and inexpensive structure and circuitry with many programmable functions. Since the features are implemented in large part in software, the system is flexible and can accommodate additional functions. The described algorithm is illustrative only, and the same or similar functions can be programmed in different manners.

What is claimed is:

1. A paired finding system comprising at least two locators, either of said two locators being usable to find the other of said two locators, each of said two locators comprising:

signal receiving means for receiving and identifying a search signal emitted from another of said locators;

beacon signaling means for emitting at least one beacon signal to which a human user is sensitive in response to said receiving means identifying said search signal; and search signaling means for emitting said search signal upon activation by said user, wherein said search signaling means emits an audio signal.

2. The system of claim 1, wherein said beacon signaling means emits an audible signal.

3. The system of claim 1, comprising an acoustic transducer receives said search signal, emits one of said at least one beacon signals, and emits said search signal.

4. An audio finding system, comprising at least two locators, either of said two locators being usable to find the other of said two locators, each of said two locators comprising:

an audio transducer; and control circuitry for receiving a first search signal through said audio transducer from another of said locators, for transmitting a second search signal to another of said locators through said audio transducer, and in response to reception of said first search signal for transmitting a beacon signal through said audio transducer that is audible to a user.

5. The system of claim 4, further comprising a visible optical emitter and wherein said control circuitry transmits a second beacon signal through said optical emitter in response to said reception of said first search signal.

6. The system of claim 5, wherein said control circuitry includes a microprocessor and wherein said visible optical emitter comprises a light emitting diode connected between a battery terminal and a power supply input of said microprocessor.

7. The system of claim 4, wherein said audio transducer comprises a piezoelectric transducer.

8. The system of claim 4, further comprising:

a case accommodating said transducer and said piezoelectric transducer and including an acoustic cavity, wherein said piezoelectric transducer is disposed on one end of said cavity; and a cap covering the other end of said acoustic cavity and spaced apart from said case by an annular port extending outwardly from a central axis of said acoustic cavity and communicating said acoustic cavity to an outside of said case.

9. The system of claim 8, wherein said cavity is circularly symmetric about said central axis.

10. The system of claim 4, wherein said circuitry includes a programmable processor operable in a first mode and in a second mode in which said processor consumes less than 1% of the power consumed in said first mode, wherein said circuitry is capable of recognizing an initial portion of said first search signal while said processor is in said second mode and in response thereto converting operation of said processor to said first mode to process a remaining portion of said first search signal.

11. A method of finding, using either of two locators to locate the other of said two locators, comprising the steps of:

transmitting from said either locator an acoustic search signal;

receiving at said other locator said search signal and identifying it as being emitted from said either locator; and in response to said identifying, emitting from said other locator a beacon signal to which a human is sensitive.

12. The method of claim 11, wherein said beacon signal is an audible signal.

13. The method of claim 11, in response to said identifying, emitting from said other locator a visible signal.

14. The method of claim 11, wherein said transmitting step transmits a sequence of tones of frequencies having predetermined frequency differences therebetween.

15. The method of claim 11, wherein said identifying includes determining a baseline frequency associated with a first one of said sequence of tones.

16. A finding system comprising a search unit and a beacon unit:

wherein said search unit comprises a first audio transducer, and first control circuitry transmitting a search signal to said beacon unit; and wherein said beacon unit comprises a second audio transducer, and second control circuitry receiving said search signal from said search unit and in response thereto transmitting a beacon signal to which a human is sensitive.

17. The finding system of claim 16, wherein said beacon signal is an audio signal.

18. The finding system of claim 16, wherein said search signal comprises a plurality of sequentially generated tones having respective and different frequencies.

19. The finding system of claim 16, wherein said search unit additionally comprises a humanly activatable button controlling said first control circuitry.

20. A method of using a search unit to find a beacon unit, comprising the steps of:

transmitting from said search unit an acoustic search signal;

receiving at said beacon unit said search signal and identifying it as being emitted from said search unit; and in response to said identifying, emitting from said beacon unit a beacon signal to which a human is sensitive.

21. The method of claim 20, wherein said beacon signal is an audio signal.

22. The method of claim 20, wherein said transmitting step transmits a sequence of tones of different respective frequencies.

* * * * *